US006507961B1

(12) United States Patent
Ming-Hwa

(10) Patent No.: US 6,507,961 B1
(45) Date of Patent: Jan. 21, 2003

(54) ELEVATING MECHANISM FOR ASSISTING PATIENT IN USING A TOILET ALONE

(75) Inventor: Shou Ming-Hwa, Hsin Tien (TW)

(73) Assignee: Dynamic Healthtech Inc., Taipei (TW)

( * ) Notice: Subject to any disclaimer, the term of this patent is extended or adjusted under 35 U.S.C. 154(b) by 0 days.

(21) Appl. No.: 10/042,568

(22) Filed: Nov. 21, 2001

(51) Int. Cl.[7] ..... A47K 13/10
(52) U.S. Cl. ..... 4/667; 297/DIG. 10
(58) Field of Search ..... 4/667, 254; 297/DIG. 10

(56) References Cited

U.S. PATENT DOCUMENTS 3,473,174 A * 10/1969 Cool ..... 4/667
5,155,873 A * 10/1992 Bridges ..... 4/667
5,189,739 A * 3/1993 Thierry ..... 4/254
6,154,896 A * 12/2000 Houston et al. ..... 4/667
6,161,229 A * 12/2000 Ryan et al. ..... 4/667
6,189,164 B1 * 2/2001 Krapu ..... 4/667
6,213,554 B1 * 4/2001 Marcoux et al. ..... 297/DIG. 10
6,360,382 B1 * 3/2002 Karash ..... 4/667

* cited by examiner

*Primary Examiner*—Charles R. Eloshway
(74) *Attorney, Agent, or Firm*—W. Wayne Liauh

(57) ABSTRACT

An elevating mechanism for assisting patient in using a toilet alone includes a base having a left and a right side frame, on which four links and an extension arm are symmetrically provided. When the two symmetrical extension arms are actuated, the four links on both side frames are lifted to ascend a seat and two armrests, so that an aged or a patient sat on the seat is lifted to an almost upstanding position without the need of supporting his or her weight completely on two weak legs.

5 Claims, 6 Drawing Sheets

ELEVATING MECHANISM FOR ASSISTING PATIENT IN USING A TOILET ALONE

BACKGROUND OF THE INVENTION

The present invention relates to an elevating mechanism that provides a supporting force to a patient or an aged having weak legs, so that the patient or the aged could sit on or stand up from a toilet without the help of an attendant.

When a person becomes older, his or her physiological functions would degrade gradually. The aged bones and muscles would result in spongy bones and reduced bone and muscle supportability. That is why old people move slower than the youth and feel laborious to sit down and stand up.

Sitting down and standing up are two movements that necessarily occur when people go to the toilet. For old people who move slowly and patients who have injured leg or legs, it is necessary to have an attendant to help them sit down and stand up in the course of using the toilet. However, to excrete is a private behavior and involves in dirty excretions. Most people would prefer to use the toilet alone without someone else standing beside him or her. The old men and/or the patients failing to do so would feel depressed, useless, or even lose the courage to live.

SUMMARY OF THE INVENTION

A primary object of the present invention is to provide an automatic elevating mechanism that is able to ascend and forward incline a seat, so as to lift an aged or a patient sat on the seat to an almost upstanding position. The aged or the patient does not need to support his or her weight completely by two legs and could stand up from a sitting position on the toilet with less energy. The automatic elevating mechanism of the present invention may also gradually descend and lay the seat into a horizontal position to help the aged or the patient rested on the seat to move into a completely sitting position from an upstanding position.

To achieve the above and other objects, the elevating mechanism according to the present invention for assisting an aged or a patient in using the toilet alone mainly includes a base, a seat, and two armrests. The base includes left and right side frames connected to each other via front and rear crossbars. The two side frames are respectively and symmetrically provided with four links and an extension arm. The two armrests are pivotally connected to some of the links on the side frames via two arm supports. The seat is fixedly supported on the links on the two side frames. The extension arms may be actuated with push buttons to lift or lower the links and thereby ascend or descend the seat and the armrests.

The seat is provided with a central opening to function like a toilet seat. When the seat is fully descended, it is in a completely horizontal position for a user to sit thereon. When the seat is gradually ascended, it also gradually inclines forward to move the user from a sitting position to an almost upstanding position. The seat in the ascended and forward inclined position enables the user to conveniently move toward or away from the toilet.

The two armrests in the elevating mechanism of the present invention are always maintained in a horizontal position in the course of lifting or lowering the links, so as to always provide safe and stable support to the user.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
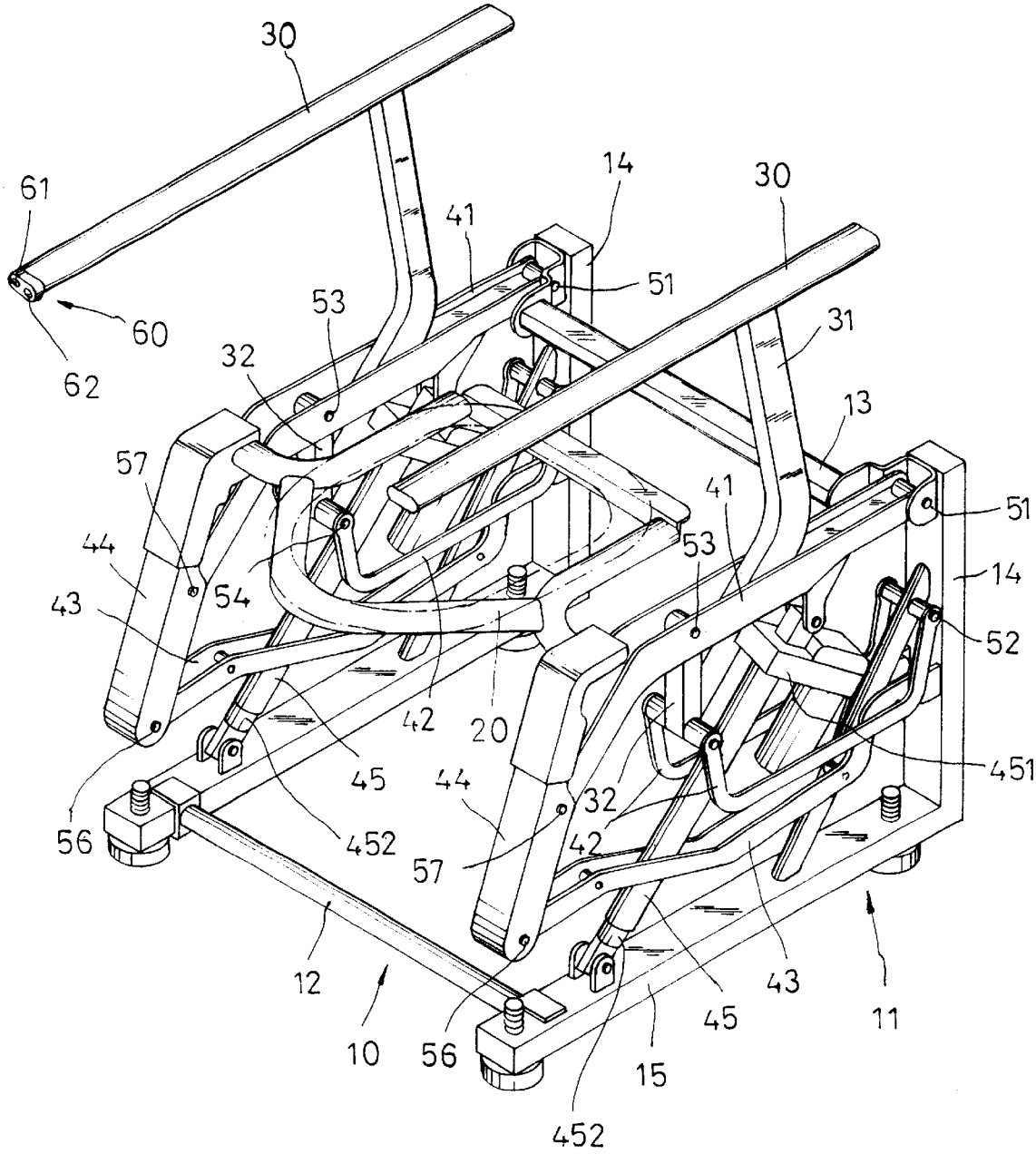
FIG. 1 is a front perspective view of an elevating mechanism according to an embodiment of the present invention for assisting a patient in using a toilet alone.
Figure 2:
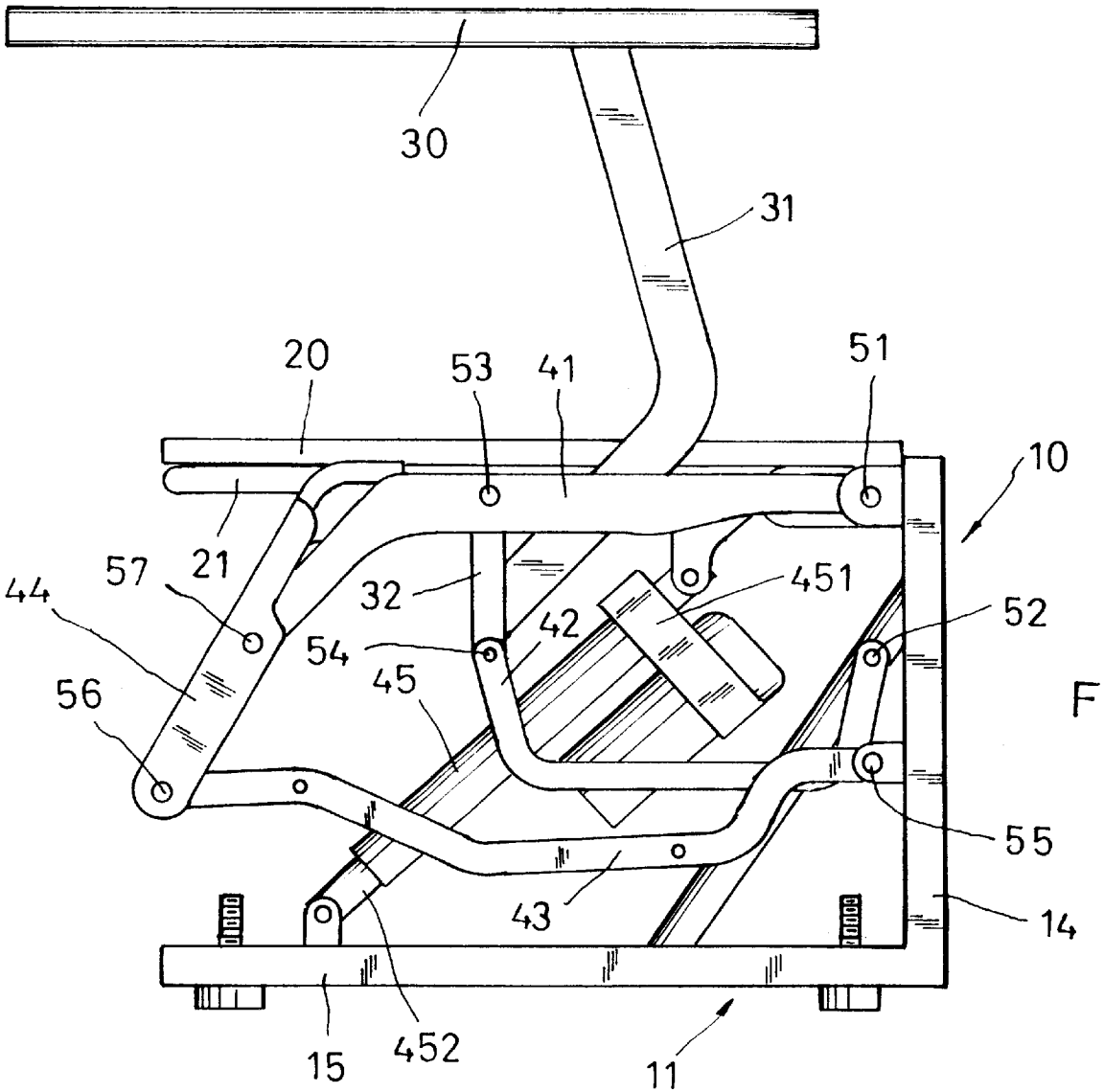
FIG. 2 is a side view of the elevating mechanism of the present invention in a lowered position.

Please refer to FIGS. 1 and 2 that are front perspective and side views, respectively, of an elevating mechanism according to an embodiment of the present invention for assisting a patient in using a toilet alone. The elevating mechanism mainly includes a base 10, a seat 20, and two armrests 30.

The base 10 includes left and right side frames 11 and front and rear crossbars 12, 13 that extend between the two side frames 11 to connect them to each other. On the left and the right side frame 11, there is laterally symmetrically provided four links 41, 42, 43, and 44, and an extension arm 45. Each of the two armrests 30 is supported on an arm support 31, a lower end of which is connected to a connecting bar 32.

The seat 20 is supported on the two fourth links 44 separately provided on the left and the right side frames 11. The first, the second, and the third link 41, 42, and 43 on each side frame 11 all are pivotally connected at an end to a rear upright post 14 of the side frame 11. Both the first and the third links 41, 43 on each side frame 11 are pivotally connected at another end to the fourth link 44. Each of the connecting bars 32 below the armrests 30 is pivotally connected at a lower end to another end of the second link 42, and at an upper end to a middle portion of the first link 41.

Figure 3:
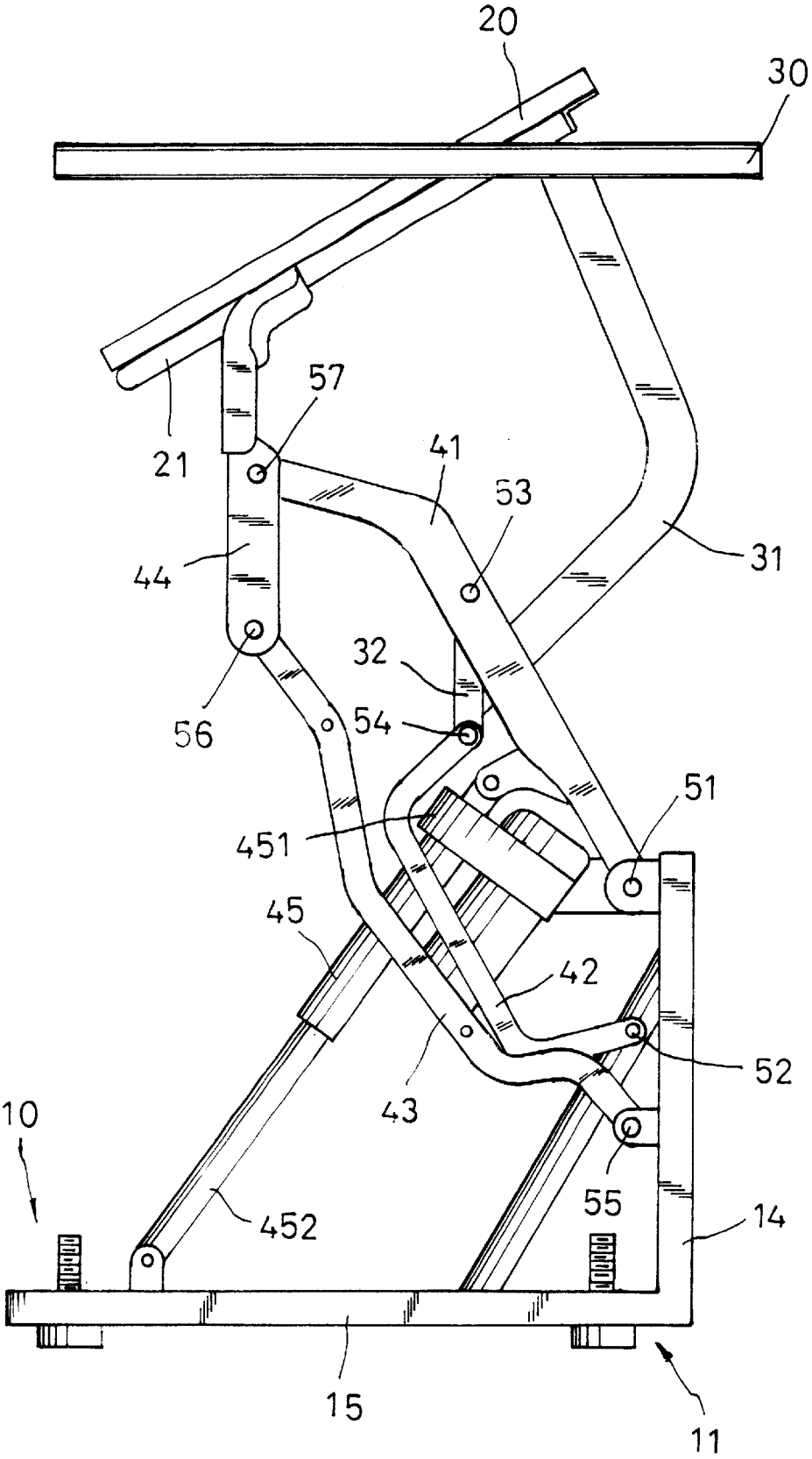
FIG. 3 is a side view of the elevating mechanism of the present invention in an elevated position.

Each of the extension arms 45 includes a main body 451, an end of which is pivotally connected to the first link 41, and an extension tube 452, an outer end of which is pivotally connected to a bottom member 15 of the side frame 11. In this manner, the first and the second links 41, 42 and the connecting bar 32 together form a first three-bar linkage, and the first, the third, and the fourth links 41, 43, 44 together form a second three-bar linkage. When the extension tubes 452 of the two extension arms 45 are extended, they directly push the first links 41 of the two side frames 11 upward. At this point, the second, the third, and the fourth links 42, 43, 44, and the connecting bars 32 pivotally connected to the first links 41 are lifted accordingly, as shown in FIG. 3. The seat 20 and the armrests 30 respectively supported on the fourth links 44 and the arm supports 31 that are pivotally connected at lower ends to the connecting bars 32 are therefore ascended to lift a patient sat on the seat 20.

In each of the first three-bar linkages formed from the first and the second links 41, 42 and the connecting bars 32, the first and the second links 41, 42 are pivotally connected at an end to the upright post 14 of the side frame 11 to form two pivoting points 51 and 52, respectively, and the connecting bar 32 is pivotally connected at upper and lower ends to another end of the first and the second links 41, 42, respectively, to form another two pivoting points 53 and 54, respectively. The four pivoting points 51, 52, 53 and 54 together form four vertexes of a parallelogram. When the first and the second links 41, 42 and the connecting bar 32 are being lifted, the four pivoting points 51, 52, 53 and 54 are always the four vertexes of a parallelogram. This enables the armrests 30 to always maintain in a horizontal position in the course of ascending and descending and therefore ensure safe and stable supporting of a user's two arms rested thereon.

Each of the fourth links 44 is pivotally connected at a lower end to the third link 43, and near a middle point to the first link 41. An upper end of the fourth link 44 is turned rearward to connect to a seat-supporting frame 21, to an upper side of which the seat 20 having a central opening is fixedly mounted. Two ends of each third link 43 pivotally connected to the upright post 14 and the fourth link 44 form two pivoting points 55 and 56, respectively, and an end of each first link 41 pivotally connected to the fourth link 44 forms a pivoting point 57. A distance between the two pivoting points 55, 56 is larger than that between the two pivoting points 51, 57. This causes the rearward-extended upper ends of the fourth links 44 to move toward a front side of the whole elevating mechanism and forward incline the seat 20 in the course of lifting the fourth links 44, as shown in FIG. 3. The lifted and forward inclined seat 20 enables a user to locate at a position very close to an upstanding position.

When the two extension arms 45 separately mounted on the two side frames 11 operate synchronously, the two armrests 30 above the two side frames 11 are ascended or descended synchronously and the seat 20 is lifted or lowered, respectively.

Figure 4:
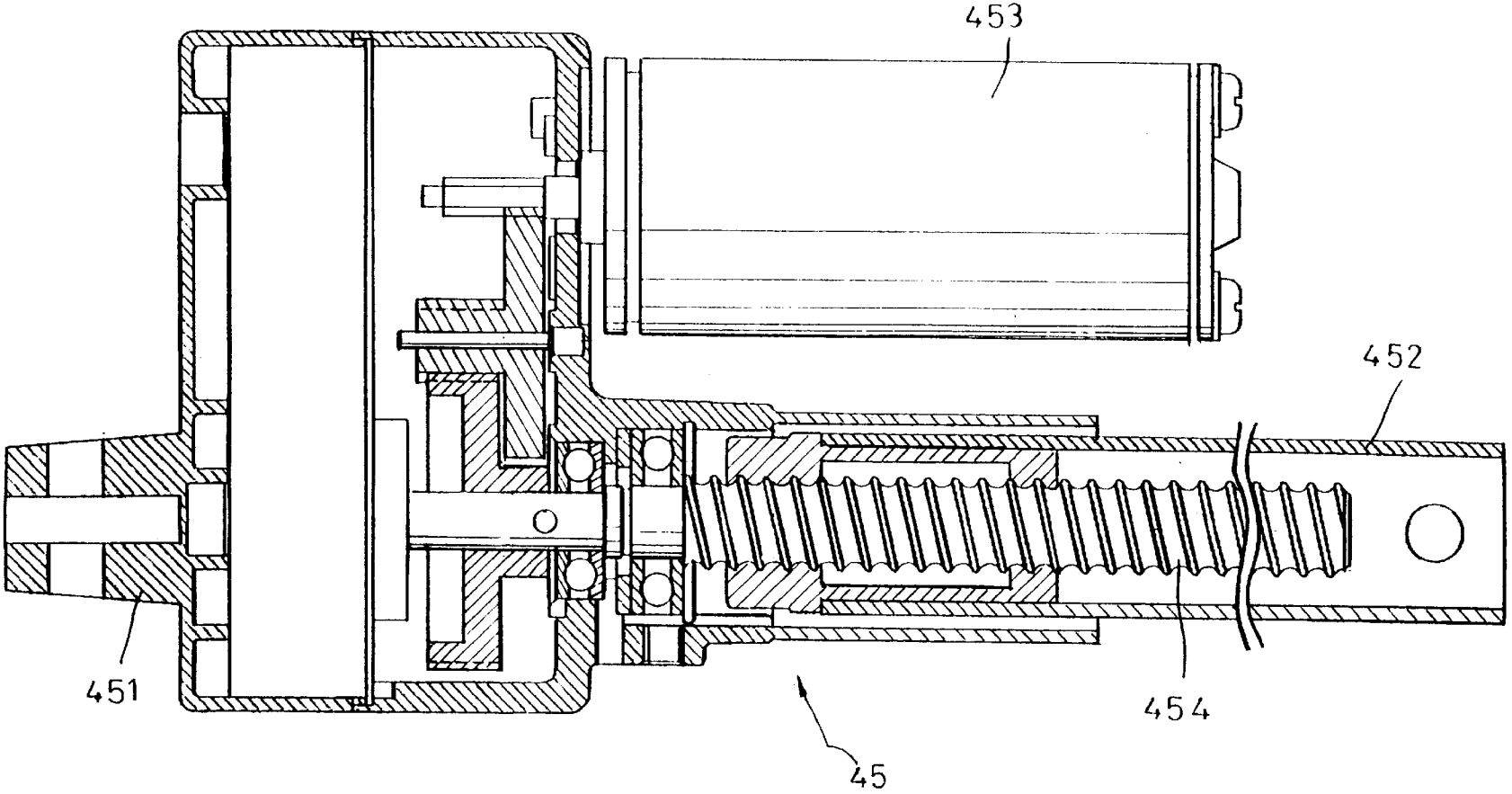
FIG. 4 is an enlarged, partially sectioned side view of an extension arm included in the present invention.

The extension arm 45 is a known art. FIG. 4 is a partially sectioned side view of the extension arm 45 employed in the present invention. As shown, the extension arm 45 includes a motor 453, a guide screw 454 driven by the motor 453 to rotate, and an extension tube 452 screwed onto the guide screw 454. When the motor 453 is started to rotate the guide screw 454, a rotating direction of the guide screw 454 decides how the extension tube 452 moves, that is, to move forward or backward relative to the guide screw 454.

The above-mentioned first, second, and third links 41, 42 and 43 all have a hollow central portion, so that the arm supports 31 of the two armrests 30 are extended through the hollow central portions of the first links 41, and the two extension arms 45 are extended through the hollow central portions of the second and the third links 42, 43.

Figure 5:
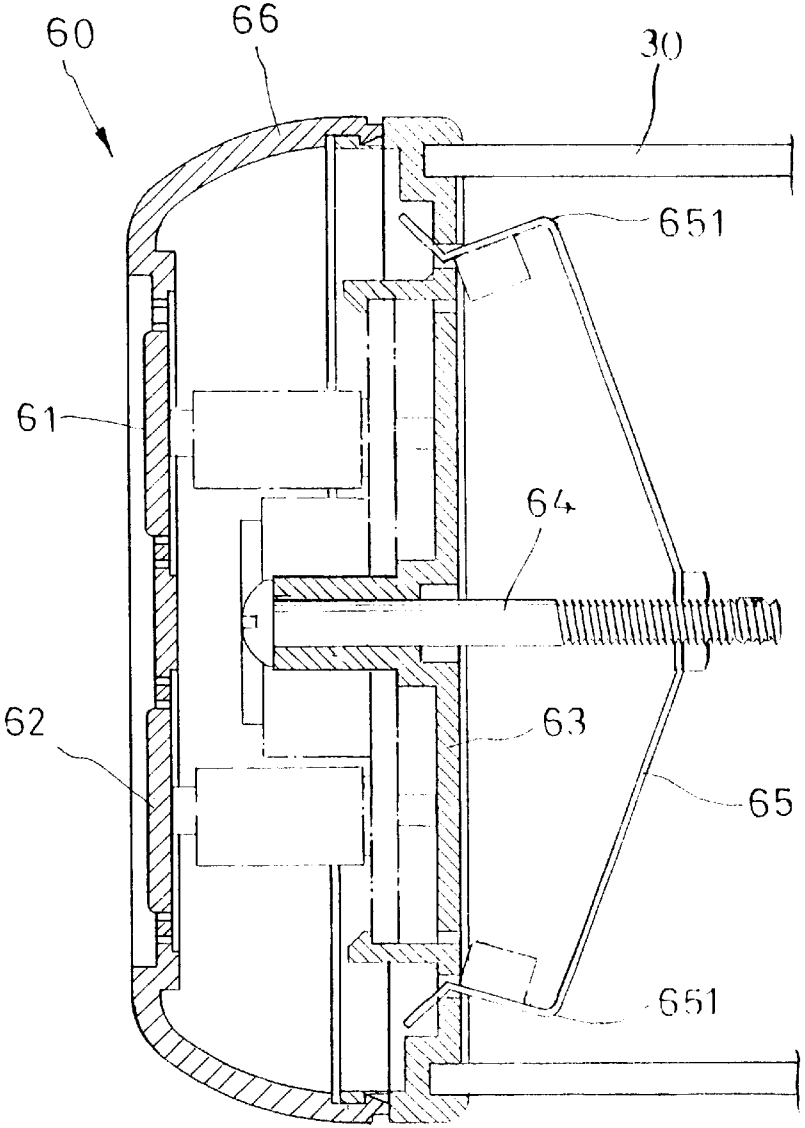
FIG. 5 is a partially sectioned side view of a push-button switch for actuating the extension arms of the present invention.

The two extension arms 45 are actuated via a push-button switch 60 provided at a front end of one of the two armrests 30, as shown in FIG. 1. A user may conveniently push one of two selection buttons 61 and 62 on the push-button switch 60 to control the extension arms 45. Please refer to FIG. 5. The push-button switch 60 includes an internal base board 63 having a screw 64 extended therethrough, and an outward-opened elastic plate 65 screwed onto an inner end of the screw 64. When the screw 64 is turned to move outward, four corners 651 of the elastic plate 65 are caused to press against an inner wall surface of the armrest 30, which has a curved inner wall surface in the illustrated embodiment, so that the base board 63 is fixed in place. A cover 66 is snapped onto a front of the base board 63 to shield the screw 64 and give the push-button switch 60 a beautiful appearance.

In the present invention, two cases (not shown) may be separately provided on the two side frames 11 to cover all the links 41, 42, 43 and 44, as well as the extension arms 45, so that they are not visible from outside and could be protected against foreign matters that might cause troubles to the entire elevating mechanism.

When an aged man or a patient goes to the toilet, he or she may first actuate the extension arms 45 to lift the seat 20 and rests his or her buttocks on the seat 20, and then lower the seat 20 and the armrests 30. In this manner, most part of the user's weight would be supported on the seat 20. And, when the user prepares to stand up, he or she may actuate the extension arms 45 to lift the seat 20 and the armrests 30 to assist the user in standing up easily. With the elevating mechanism of the present invention, the aged or the patient going to the toilet does not need to support his or her weight completely by two legs, and could therefore use the toilet alone without the help of an attendant.

Figure 7:
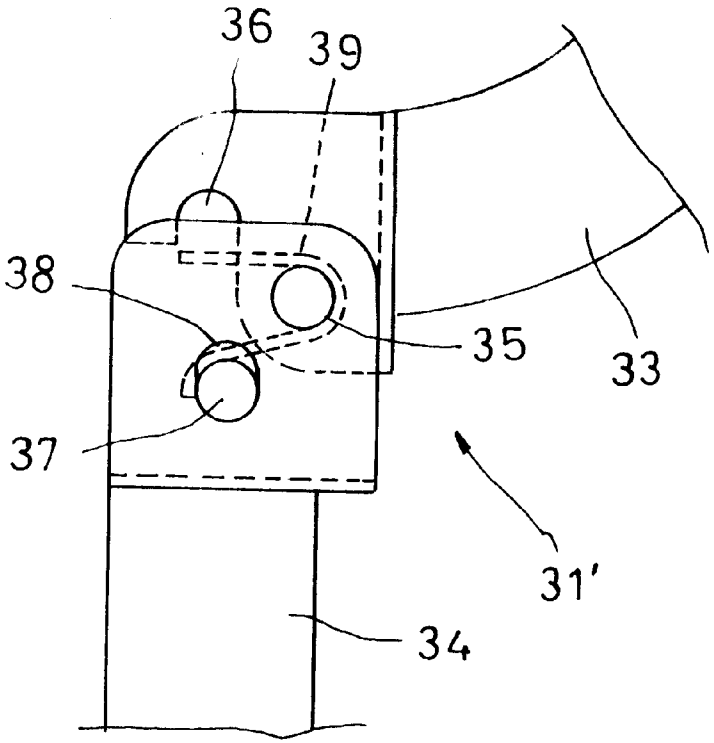
FIG. 7 shows the two-section arm support of FIG. 6 in a bent state.
Figure 6:
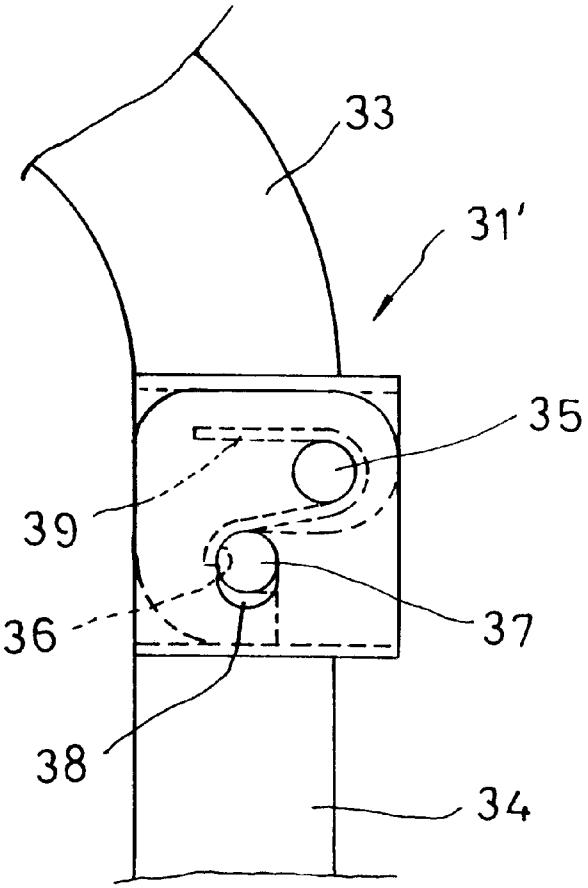
FIG. 6 is a fragmentary side view showing a two-section arm support included in the present invention.

In the present invention, at least one of the two armrests 30 could be connected to a two-section arm support 31' instead of the fixed arm support 30. Please refer to FIG. 6. The two-section arm support 31' includes an upper section 33 and a lower section 34 pivotally connected to each other via a pivot shaft 35. The upper section 33 is provided near a lower end with a retaining recess 36, and the lower section 34 is provided with a stop pin 37 corresponding to the retaining recess 36. When the retaining recess 36 engages with the stop pin 37, the upper and the lower sections 33, 34 are connected to each other. When the upper section 33 is bent rearward and downward about the pivot shaft 35, the retaining recess 36 is caused to disengage from the stop pin 37, as shown in FIG. 7, and the armrest 30 supported on the two-section arm support 31' is inclined rearward (not shown), allowing a user to move toward or away from the seat 20 via one side of the elevating mechanism. As can be seen from FIGS. 6 and 7, the stop pin 37 is extended through a long hole 38 and could therefore be slightly shifted up and down. A torsional spring 39 is mounted on the pivot shaft 35 and the stop pin 37 to apply a downward pressure on the stop pin 37. When the retaining recess 36 of the upper section 33 is engaged with the stop pin 37, it pulls the stop pin 37 upward. The upward pull of the retaining recess 36 and the downward pressure of the torsional spring 39 together enable the two sections 33, 34 of the arm support 31' to firmly and stably engage with each other.

The elevating mechanism of the present invention employs simple linkages to provide elevating operations that meet the human body engineering to help the aged and patients to use the toilet alone. The present invention not only helps the aged and the patients to maintain their self-respect but also relieves the attendant's work.

What is claimed is:

1. An elevating mechanism for assisting patient in using a toilet alone, comprising a base, a seat, and two armrests;

said base including left and right side frames, and front and rear crossbars extended between said two side frames to connect them to each other;

said left and said right side frames being respectively and symmetrically provided with four links, namely, first, second, third, and fourth links, and an extension arm, and each of said two armrests being supported on an arm support, a lower end of which being connected to a connecting bar;

said seat being supported on said fourth links on said left and said right side frames;

said first, said second, and said third links on each of said side frames all being pivotally connected at an end to a rear upright post of said side frame; both said first and said third links on each of said side frames being pivotally connected at another end to said fourth link; each of said connecting bars below said armrests being pivotally connected at a lower end to another end of said second link and at an upper end to a middle portion of said first link; and each of said extension arms including a main body, an end of which being pivotally connected to said first link, and an extension tube, an outer end of which being pivotally connected to a bottom member of said side frame;

whereby said first and said second links and said connecting bar on each said side frame together form a first three-bar linkage, and said first, said third, and said fourth links on each said side frame together form a second three-bar linkage; and whereby when said extension tubes of said two extension arms are extended, they directly push said first links of said two side frames upward to lift said second, said third, and said fourth links, and said connecting bars at the same time, and thereby ascend said seat and said armrests respectively supported on said fourth links and said arm supports that are pivotally connected at lower ends to said connecting bars.

2. The elevating mechanism for assisting patient in using a toilet alone as claimed in claim 1, wherein each of said first three-bar linkages formed from said first and said second links and said connecting bars below said armrests includes four pivoting points that form four vertexes of a parallelogram.

3. The elevating mechanism for assisting patient in using a toilet alone as claimed in claim 1, wherein each of said third links provides at two ends with two pivoting points, and each of said first links provides at two ends with another two pivoting points; and a distance between said two pivoting points on said third link being larger than that between said another two pivoting points on said first link.

4. The elevating mechanism for assisting patient in using a toilet alone as claimed in claim 1, wherein both said first links have a hollow central portion, through which said arm supports are extended to connect to said connecting bars.

5. The elevating mechanism for assisting patient in using a toilet alone as claimed in claim 1, wherein both said second links and said third links have a hollow central portion, through which said extension arms are extended.

* * * * *